US011299794B2

(12) United States Patent
Koch et al.

(10) Patent No.: US 11,299,794 B2
(45) Date of Patent: Apr. 12, 2022

(54) HOT-FORMING LINE AND METHOD FOR PRODUCING HOT-FORMED AND PRESS-QUENCHED SHEET-STEEL PRODUCTS

(71) Applicant: Ford Global Technologies, LLC, Dearborn, MI (US)

(72) Inventors: Raphael Koch, Odenthal (DE); Maik Broda, Würselen (DE); Ferat Oezkan, Übach-Palenberg (DE); Ilya Popov, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 202 days.

(21) Appl. No.: 16/414,999

(22) Filed: May 17, 2019

(65) Prior Publication Data

US 2019/0352735 A1 Nov. 21, 2019

(30) Foreign Application Priority Data

May 17, 2018 (DE) ..... 102018207798.3

(51) Int. Cl.
*C21D 9/48* (2006.01)
*C21D 1/673* (2006.01)

(52) U.S. Cl.
CPC ..... *C21D 9/48* (2013.01); *C21D 1/673* (2013.01)

(58) Field of Classification Search
CPC ..... C21D 1/673; C21D 9/48
USPC ..... 266/260, 103, 249, 252, 259; 148/637, 148/644, 658, 647, 654; 72/342.1–342.6, 72/352, 364, 8.5, 60
See application file for complete search history.

(56) References Cited

U.S. PATENT DOCUMENTS 4,383,677 A * 5/1983 Kerr ..... C21D 1/60 266/87
4,569,218 A 2/1986 Baker et al.
4,712,413 A * 12/1987 Koch ..... B21J 1/06 164/900
5,737,960 A * 4/1998 Brandstetter ..... B21D 43/055 72/405.16

(Continued)

FOREIGN PATENT DOCUMENTS

CN 103192380 * 7/2013 ..... B25J 19/00
CN 203854005 * 10/2014 ..... B25J 15/08
RU 2468883 12/2012

*Primary Examiner* — Jessee R Roe
*Assistant Examiner* — Michael Aboagye
(74) *Attorney, Agent, or Firm* — Burris Law, PLLC

(57) ABSTRACT

A hot-forming line for producing hot-formed and press-quenched sheet-steel products includes a temperature control station for heating at least one sheet-metal blank, a hot-forming and press-quenching tool for hot forming and press quenching the heated sheet-metal blank and at least one blank gripper for gripping and transferring the sheet-metal blank before and/or after hot forming and press quenching. The at least one blank gripper forms at least one contact region with the sheet-metal blank during the gripping of the sheet-metal blank. Also, the at least one blank gripper is configured to cool the sheet-metal blank in the at least one contact region during gripping and transfer of the sheet-metal blank before hot forming and press quenching and/or heat the sheet-metal blank in the at least one contact region during gripping and transfer after hot forming and press quenching.

18 Claims, 4 Drawing Sheets

(56) References Cited

U.S. PATENT DOCUMENTS

| | | | | |
|---|---|---|---|---|
| 6,499,777 | B1 | 12/2002 | Wang | |
| 9,061,340 | B2 | 6/2015 | Lee et al. | |
| 9,694,408 | B2 * | 7/2017 | Trippe | C22C 38/06 |
| 2011/0283851 | A1 * | 11/2011 | Overrath | B21D 22/00 83/15 |
| 2017/0183755 | A1 | 6/2017 | Frost et al. | |
| 2018/0071806 | A1 * | 3/2018 | Song | B21D 37/16 |

* cited by examiner

HOT-FORMING LINE AND METHOD FOR PRODUCING HOT-FORMED AND PRESS-QUENCHED SHEET-STEEL PRODUCTS

CROSS-REFERENCE TO RELATED APPLICATIONS

This application claims priority to and the benefit of German Application Number 102018207798.3 filed on May 17, 2018. The disclosure of the above application is incorporated herein by reference.

FIELD

The present disclosure relates to a hot-forming line for producing hot-formed and press-quenched sheet-steel products.

BACKGROUND

The statements in this section merely provide background information related to the present disclosure and may not constitute prior art.

The prior art discloses the practice of producing sheet-steel products by means of hot forming and press quenching. For this purpose, a sheet-metal blank composed of a hardenable steel alloy is heated at least in some region or regions to a temperature above the austenitization temperature. Following heating, the sheet-metal blank is placed in a hot-forming tool and hot formed in this hot state. On completion of the hot-forming process, the formed component is cooled in the hot-forming tool with a rapidity such that hardening of the material structure is initiated. This is referred to as a press-quenching process.

To carry out a production process of this kind, there is therefore a need for a heating station, also referred to as a temperature control station, and a hot-forming and press-quenching tool. In the temperature control station, the sheet-metal blank is held, for example, at a temperature of about 930° C. for a period of a few minutes, e.g. about 6 minutes. After hot forming, the sheet-metal blank, composed of the material 22 MnB5 by way of example, is cooled rapidly at a cooling rate greater than 27 K/s in order to form a martensitic microstructure in the sheet-metal blank to achieve the desired hardening. Between the individual stations or tools, manipulators, generally in the form of industrial robots, are used to transfer the sheet-metal blanks or components from one station to the next.

A hot-forming line of this kind is shown by US 2017/0183755 A1, for example. Blank grippers that can be moved in a linear manner along a linear conveyor system are used as manipulators to transfer the sheet-metal blanks from the temperature control station to the hot-forming and press-quenching tool.

U.S. Pat. Nos. 4,712,413 A and 4,569,218 A each disclose an apparatus for forming heated metal preforms, in which the heated metal preforms are transferred to a forming tool by a gripper. In order to prevent excessive heat loss from the preforms during transfer by the gripper before forming of said preforms, this gripper is equipped with an electric heating device for heating gripper claws.

RU 2 468 883 C1 discloses a forging manipulator with gripper claws, wherein the contact regions of the gripper claws, which are in contact with a workpiece, have a zirconium coating to reduce thermal conductivity CN 103192380 A describes a robot gripper which is attached to a robot arm and which can be heated by means of a heating device, depending on an ambient temperature.

U.S. Pat. No. 6,499,777 B1 has furthermore disclosed a gripping member for transferring hot-worked wafers, which are cooled while being transferred by means of the gripping member. The gripping member has means for heat transfer by convection and heat conduction.

U.S. Pat. No. 9,061,340 B2 discloses a hot-forming and press-quenching tool for hot forming and press quenching tailored shaped parts, wherein the shaped part made up of two sheet-metal blanks of different thickness, which are joined together by means of welding, is formed and hardened together with its weld seam in the hot-forming and press-quenching tool. Since it is not possible to produce a sufficiently large direct contact surface between the irregularly shaped weld seam and the hot-forming and press-quenching tool, it is proposed to provide a recess in the hot-forming and press-quenching tool in the region of the weld seam of the shaped part to be formed, through which recess coolant flows during the cooling and hardening process, ensuring that the weld seam region of the shaped part is cooled in the same way as the remaining region of the joined sheet-metal blanks. This is intended to provide strength of the weld seam region.

Normally, the hot-formed and press-quenched sheet-steel products are joined in a materially integral manner after production to other components, e.g. other hot-formed and press-quenched sheet-steel products, by means of thermal joining techniques, e.g. by welding or spot welding. In this way, for example, connecting flanges of a hot-formed and press-quenched B pillar of a vehicle can be joined to the rest of the vehicle structure or vehicle body.

Since thermal joining techniques such as welding lead to renewed introduction of heat into the hot-formed and press-quenched sheet-metal product, however, a heat affected zone (HAZ) is formed at the welds, wherein the introduction of heat causes local conversion of the martensitic material structure of the sheet-metal product. Thus, after welding, some regions of the finished sheet-metal product can have a high hardness in the region of the welds, whereas other regions have a lower hardness. Such a high hardness/lower hardness region is often referred to as a "metallurgical notch."

The present disclosure addresses the issues of hot forming press-quenched sheet-steel products.

SUMMARY

In one form of the present disclosure, an improved hot-forming line for producing hot-formed and press-quenched sheet-steel products is provided. The improved hot-forming line provides for the production of hot-formed and press-quenched sheet-metal products which, after being joined or connected to other (sheet-metal) components, in particular by thermal joining techniques such as welding, do not exhibit a metallurgical notch and any weakening of joints in the joined sheet-metal parts. Moreover, the production of sheet-metal products of this kind can be advantageous in terms of time and costs.

It should be noted that the features presented individually in the following description can be combined in any technically feasible way, giving rise to further forms and aspects of the present disclosure. The description additionally characterizes and specifies the present disclosure, particularly in conjunction with the figures.

It should furthermore be noted that a conjunction "and/or" used hereinbelow between two features and linking said features should always be interpreted to mean that, in a first aspect of the present disclosure, only the first feature is present, in a second aspect of the present disclosure, only the second feature is present and, in a third aspect of the present disclosure, both the first and the second feature are present.

In at least one form of the present disclosure a hot-forming line for producing hot-formed and press-quenched sheet-steel products includes a temperature control station for heating at least one sheet-metal blank, a hot-forming and press-quenching tool for hot forming and press quenching the heated sheet-metal blank and at least one blank gripper for gripping and transferring the sheet-metal blank before and/or after hot forming and press quenching. The temperature control station can be a furnace (chamber furnace, roller hearth furnace), or a unit which heats the sheets, i.e. the sheet-metal blank, by contact heating or adjusts the temperature thereof in an appropriate manner by inductive or conductive introduction of heat.

In some aspects of the present disclosure, a single blank gripper (e.g., a first blank gripper) is provided to transfer the sheet-metal blank between the temperature control station and the hot-forming and press-quenching tool. In other aspects of the present disclosure, a single blank gripper (e.g., a second blank gripper) is provided to transfer the sheet-metal blank between the hot-forming and press-quenching tool and a processing and/or storage station arranged downstream of the latter in the hot-forming line. In still other aspects of the present disclosure, a single blank gripper is provided to transfer the sheet-metal blank between the temperature control station and the hot-forming and press-quenching tool and to transfer the sheet-metal blank between the hot-forming and press-quenching tool and a processing and/or storage station arranged downstream of the latter in the hot-forming line. In still yet other aspects of the present disclosure, a plurality of blank grippers is provided to transfer the sheet-metal blank between the temperature control station and the hot-forming and press-quenching tool and another plurality of blank grippers is provided to transfer the sheet-metal blank between the hot-forming and press-quenching tool and a processing and/or storage station arranged downstream of the latter in the hot-forming line.

The at least one blank gripper forms at least one contact region with the sheet-metal blank during gripping and transfer of the sheet-metal blank. The at least one blank gripper is configured to cool the sheet-metal blank during gripping and transfer, before hot forming and press quenching, in the at least one contact region in relation to an uncontacted neighboring region of the sheet-metal blank adjoining the contact region, and/or to heat the sheet-metal blank during gripping and transfer, after hot forming and press quenching, in the at least one contact region in relation to the uncontacted neighboring region of the sheet-metal blank adjoining the contact region. In other words, the at least one blank gripper provides that the sheet-metal blank is cooled in a defined manner in the contact region in relation to the neighboring region of the sheet-metal blank, before hot forming and press quenching by means of the hot-forming and press-quenching tool, and/or provides that the sheet-metal blank is heated in the contact region in relation to the neighboring region of the sheet-metal blank, after hot-forming and press quenching by means of the hot-forming and press-quenching tool. Accordingly, the at least one blank gripper performs the function of providing defined heat transfer from the contact region of the sheet-metal blank to the at least one blank gripper and/or from the at least one blank gripper to the contact region of the sheet-metal blank in a desired manner.

In some aspects of the present disclosure, the at least one blank gripper includes a first blank gripper and a second blank gripper. In such aspects, the first blank gripper is configured to cool the sheet-metal blank in the at least one contact region in relation to the uncontacted neighboring region during gripping and transferring by the first blank gripper before hot forming and press quenching. Also, the second blank gripper is configured to heat the sheet-metal blank in the at least one contact region in relation to the uncontacted neighboring region during gripping and transferring by the second blank gripper after hot forming and press quenching.

In another form of the present disclosure, a hot-forming line for producing hot-formed and press-quenched sheet-steel products includes a temperature control station for heating at least one sheet-metal blank, a hot-forming and press-quenching tool for hot forming and press quenching the heated sheet-metal blank, a first blank gripper and a second blank gripper. The first blank gripper is configured for gripping and transferring the sheet-metal blank before hot forming and press quenching. Also, the first blank gripper forms and cools at least one contact region with the sheet-metal blank in relation to an uncontacted neighboring region adjoining the contact region during the gripping of the sheet-metal blank by the first blank gripper. The second blank gripper is configured for gripping and transferring the sheet-metal blank after hot forming and press quenching. Also, the second blank gripper heats the at least one contact region in relation to the uncontacted neighboring region of the sheet-metal blank adjoining the contact region during the gripping of the sheet-metal blank by the second blank gripper. In some aspects of the present disclosure, the first blank gripper is configured to place the sheet-metal blank in the hot-forming and press-quenching tool before hot forming and press quenching, and the second blank gripper is configured to remove the sheet-metal blank from the hot-forming and press-quenching tool after hot forming and press quenching.

In some aspects of the present disclosure, cooling is provided passively by heat conduction through the at least one blank gripper and/or actively by a coolant, e.g. water or oil, which cools the at least one blank gripper and flows at least partially through the latter. Heating can be provided by an appropriate heating device formed in or on the at least one blank gripper, e.g. by electric heating wires.

Cooling only the contact region of the sheet-metal blank before it is formed and press quenched in the hot-forming and press-quenching tool has the effect that the martensitic microstructure is formed in the sheet-metal material with the desired high hardness only in the uncontacted region of the sheet-metal blank during press quenching. In contrast, the contact region has a metal structure which is significantly softer or more ductile than the martensitic structure, this being particularly advantageous in respect of possible subsequent joining with other components/sheet-metal blanks, brought about, in particular, by welding/spot welding, in precisely this contact region of the sheet-metal blank, since this contact or joining region is not weakened by the local introduction of heat due to welding.

Heating only of the contact region of the sheet-metal blank after it has been formed and press quenched in the hot-forming and press-quenching tool has the effect that the hard martensitic microstructure of the sheet-metal blank produced in the contact region by the press quenching is converted into a softer, more ductile microstructure, this being particularly advantageous in respect of possible subsequent joining with other components/sheet-metal blanks, brought about, in particular, by welding/spot welding, in precisely this contact region of the sheet-metal blank, since this contact or joining region is not weakened by the local introduction of heat due to welding. In other words, the selective heating of the martensitic microstructure present in the contact region of the sheet-metal blank leads to "tempering" of the material structure precisely in this region.

The heat treatment of the contact region of the sheet-metal blank during gripping and transfer by the sheet-metal gripper makes it possible to completely dispense with expensive subsequent additional special aftertreatment of this region or regions of the sheet-metal blank. The production time and costs for the production processes are thereby significantly reduced.

In some aspects of the present disclosure, the at least one blank gripper is configured to cool the contact region at a cooling rate of less than 27 K/s before the hot forming and press quenching of the sheet-metal blank. This reduces (e.g., prevents) martensitic microstructure formation in the contact region of the sheet-metal blank during cooling by the at least one blank gripper.

In other aspects of the present disclosure, the at least one blank gripper is configured to heat the contact region after the hot forming and press quenching of the sheet-metal blank to a temperature greater than a temperature of the uncontacted neighboring region of the sheet-metal blank adjoining the contact region but to no more than 900° C., for example no more than about 700° C. in order to reduce stresses in the contact region of the sheet-metal blank, to reduce the hardness in this region and to increase toughness. Depending on the metal alloy used for the sheet-metal blank, temperatures of about 500° C. or even less, e.g. about 300° C., may also be provided.

In some aspects of the present disclosure, the at least one contact region is arranged in a joining section of the sheet-metal blank, which is distinguished by the fact that the hot-formed and press-quenched sheet-steel product is subsequently joined to another (sheet-metal) component in this joining section, in particular in a materially integral manner by means of thermal joining techniques such as welding or spot welding.

In at least one aspect of the present disclosure, the joining section is a connecting flange of the sheet-metal blank, i.e. a substantially flat joining section. In such an aspect, the contact region formed by the gripping of the sheet-metal blank by the at least one blank gripper is likewise flat, wherein the contact surface can be matched substantially to the size of the connecting flange.

In some aspects of the present disclosure, the at least one blank gripper is configured to place the sheet-metal blank in the hot-forming and press-quenching tool before hot forming and press quenching, and/or to remove the sheet-metal blank from the hot-forming and press-quenching tool after hot forming and press quenching. In other words, the at least one blank gripper, which is normally provided in any case for placing and/or removing the sheet-metal blank in or from the hot-forming and press-quenching tool, can simultaneously be used for the heat treatment of the contact region of the sheet-metal blank as described herein and additional special blank grippers are not required for this purpose.

In another form of the present disclosure, a method for producing hot-formed and press-quenched sheet-steel products is provided. The method includes the following steps:

heating at least one sheet-metal blank in a temperature control station;

hot forming and press quenching the heated sheet-metal blank in a hot-forming and press-quenching tool; and gripping and transferring the sheet-metal blank by at least one blank gripper before and/or after hot forming and press quenching.

The sheet-metal blank is cooled by the at least one blank gripper, before hot forming and press quenching, in at least one contact region formed during gripping and transfer by the blank gripper, in relation to an uncontacted neighboring region of the sheet-metal blank adjoining the contact region, and/or is heated by means of the blank gripper, after hot forming and press quenching, in the at least one contact region, in relation to the uncontacted neighboring region of the sheet-metal blank adjoining the contact region.

As regards method-related definitions of terms and as regards the effects and advantages of methodological features, attention is drawn to the above explanations of related definitions, effects and advantages in respect of the apparatus according to the teachings of the present disclosure. It should be possible, mutatis mutandis, to make reference to disclosures in this document in respect of the apparatus according to the present disclosure also for the definition of the method according to the present disclosure, unless this is explicitly excluded herein. It should likewise be possible to make reference to disclosures in this document in respect of the method according to the present disclosure mutatis mutandis for the definition of the apparatus according to the present disclosure, unless this is likewise explicitly excluded herein.

In some aspects of the present disclosure, the sheet-metal blank is cooled in the contact region by means of the at least one blank gripper at a cooling rate of less than 27 K/s before hot forming and press quenching. In the alternative, or in addition to, the sheet-metal blank is heated in the contact region by the at least one blank gripper after hot forming and press quenching to a temperature greater than a temperature of the uncontacted neighboring region of the sheet-metal blank adjoining the contact region but to no more than about 900° C. Lower temperatures in this regard, as already mentioned above, are likewise possible.

In some aspects of the present disclosure, the sheet-metal blank is placed in the hot-forming and press-quenching tool by the at least one blank gripper before hot forming and press quenching, and/or is removed from the hot-forming and press-quenching tool by the at least one blank gripper after hot forming and press quenching.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
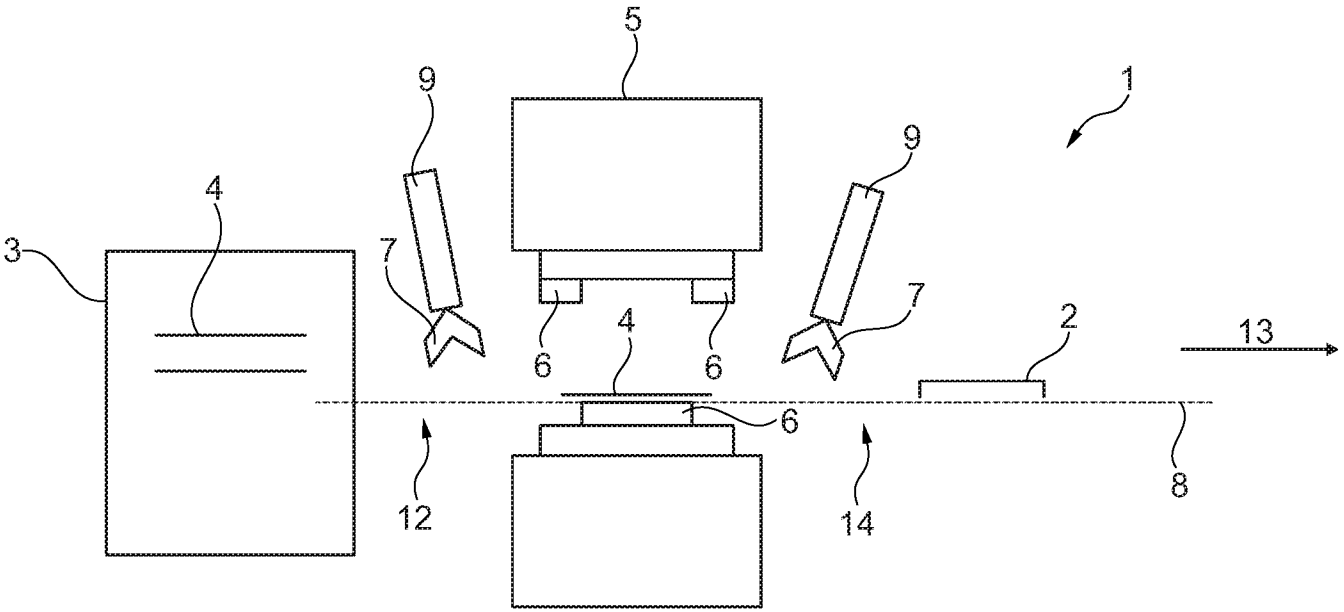
FIG. 1 shows a side view of a segment of one illustrative form of a hot-forming line according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows schematically a side view of a segment of one illustrative form of a hot-forming line 1 according to the teachings of the present disclosure. The hot-forming line 1 is used to produce hot-formed and press-quenched sheet-steel products 2, e.g. from the material 22 MnB5. As can furthermore be gathered from FIG. 1, the illustrated segment of the hot-forming line 1 has a temperature control station 3 for heating at least one sheet-metal blank 4. The temperature control station 3 can be configured to simultaneously heat a plurality of sheet-metal blanks 4, as illustrated in FIG. 1. However, this is not essential, and therefore the temperature control station 3 can also be configured merely to heat a single sheet-metal blank 4 in each case. In the temperature control station 3, the sheet-metal blank 4 is heated to about 930° C. for a period of a few minutes, e.g. about 6-8 minutes. In the case of contact heating, this process can also take just a few seconds.

Moreover, the hot-forming line 1 illustrated in FIG. 1 has a hot-forming and press-quenching tool 5 for hot forming and press quenching the sheet-metal blank 4 heated beforehand in the temperature control station 3. In the hot-forming and press-quenching tool 5, the heated sheet-metal blank 4 is hot formed by forming tools 6 (e.g. female and male dies) and then rapidly cooled, in particular at a cooling rate greater than 27 K/s, in order to produce a martensitic hardening (hardened) microstructure in the sheet-metal blank 4.

Furthermore, the hot-forming line 1 in FIG. 1 has two blank grippers 7 for gripping and transferring the sheet-metal blank 4. In the illustrative form shown, a sheet-metal gripper 7 is responsible for transferring the heated sheet-metal blank 4 coming from the temperature control station to the hot-forming and press-quenching tool 5 (also being referred to herein as the first blank gripper 7), while a second blank gripper 7 is provided for removing the hot-formed and press-quenched sheet-metal blank 4 from the hot-forming and press-quenching tool 5. It should be understood that a larger number or a smaller number of blank grippers 7 can be provided. In addition to the blank grippers 7, it is furthermore possible to provide a conveyor belt 8 for transferring the sheet-metal blanks 4 over relatively large distances. However, this is not necessary if the transfer distances between the individual stations of the hot-forming line 1 can be crossed by the blank gripper or grippers 7 alone. For this purpose, a blank gripper 7 can be controlled by a robot 9.

In the state of the hot-forming line 1 which is illustrated in FIG. 1, a sheet-metal blank 4 to be hot formed and press quenched is currently between the forming tools 6 of the hot-forming and press-quenching tool 5, while a sheet-metal blank which has already been hot formed and press quenched, representing a fully hot-formed and press-quenched sheet-steel product 2, is being transferred by the conveyor belt 8 to a station (not shown) of the hot-forming line 1 situated downstream of the hot-forming and press-quenching tool 5. This can be a storage station for the hot-formed and press-quenched sheet-steel products 2, for example.

Figure 2:
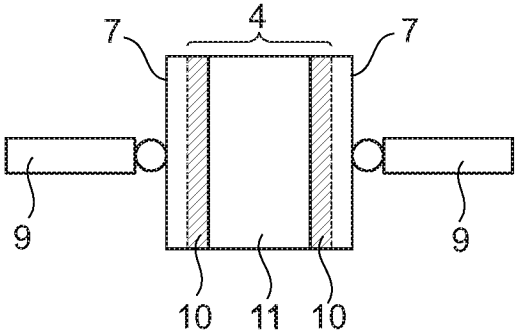
FIG. 2 shows a plan view of one illustrative form of a blank gripper of the hot-forming line from FIG. 1.

FIG. 2 shows schematically a plan view of one of the two blank grippers 7 of the hot-forming line 1 from FIG. 1 with a sheet-metal blank 4 gripped by said gripper.

In FIG. 2, it can be seen that the blank gripper 7 forms two contact regions 10 with the gripped sheet-metal blank 4. That region of the sheet-metal blank 4 which is adjacent to or adjoins the contact regions 10 of the sheet-metal blank 4 and is not contacted by the blank gripper 7 is denoted herein as a neighboring region 11 of the sheet-metal blank 4. As can be seen from FIG. 2, both contact regions 10 of the blank gripper 7 in the illustrative form shown are of flat design and each correspond, for example, to a joining section, in particular a connecting flange, of the sheet-metal blank 4 or of the finished sheet-steel product 2, by means of which the sheet-steel product 2 can subsequently be joined to other components or sheet-steel products, in particular by thermal joining techniques such as welding or spot welding.

Both blank grippers 7 of the hot-forming line 1 are of substantially identical design in respect of the contact region 10 formed by the sheet-metal blank 4, and therefore the statements in this regard that relate to one of the two blank grippers 7 apply in the same way also to the other blank gripper 7. The two blank grippers 7 of the hot-forming line 1 differ only in the manner of heat transfer that takes place between them and the sheet-metal blank 4 gripped by them. Whereas the first blank gripper 7, which is arranged between the temperature control station 3 and the hot-forming and press-quenching tool 5, provides heat transfer away from the contact region 10 of the sheet-metal blank 4, that is to say therefore for reducing the temperature of the contact region 10 in the manner described herein, the second blank gripper 7, which is arranged downstream of the hot-forming and press-quenching tool 5, provides heat to the contact region 10 of the formed and press-quenched sheet-metal blank 4 in order to heat the contact regions 10 in the manner described herein.

Thus, the first blank gripper 7 of the illustrative hot-forming line 1 shown in FIG. 1 is configured to cool the sheet-metal blank 4 during gripping and transfer, before hot forming and press quenching, in the contact regions 10 in relation to the uncontacted neighboring region 11 of the sheet-metal blank 4, and the second blank gripper 7 is configured to heat the sheet-metal blank 4 during gripping and transfer, after hot forming and press quenching, in the contact regions 10 in relation to the uncontacted neighboring region 11 of the sheet-metal blank 4 adjoining the contact regions 10. For this purpose, the first blank gripper 7 has appropriate active and/or passive heat dissipation means (not illustrated), and the second blank gripper 7 has corresponding heat supply means (likewise not illustrated).

Attention may once again be drawn at this point to the fact that the two blank grippers 7 in the illustrative hot-forming line 1 illustrated in FIG. 1, which are configured in the manner described above, do not necessarily have to be configured in the manner described above. Thus, in a different illustrative form of a hot-forming line according to the present disclosure which is not illustrated, it would be possible, for example, for just the first blank gripper 7 to be configured for the heat dissipation described herein from the contact region 10 of the sheet-metal blank 4 to the blank gripper 7, while the second blank gripper 7 could also be configured without any heat supply means. It would likewise be possible for just the second blank gripper 7 to be configured for heat supply from the blank gripper 7 to the contact region 10 of the sheet-metal blank 4, in which case it would then be possible for the first blank gripper 7 not to have heat dissipation means. In both cases, a hot-forming line of this kind would make the contact region 10 of the sheet-metal blank 4 softer and more ductile than the martensitically hardened region 11 of the sheet-metal blank 4 in order to overcome the disadvantages in the prior art which were described at the outset. However, a hot-forming line 1 of the kind illustrated in FIG. 1, having two blank grippers 7 for active heating, can even further increase the effectiveness of the selective heat treatment, described herein, of the contact regions 10 of the sheet-metal blank 4.

The first blank gripper 7 is configured to cool the contact regions 10 of the sheet-metal blank 4 at a cooling rate of less than 27 K/s before hot forming and press quenching. The second blank gripper 7 is configured to heat the contact regions 10 of the sheet-metal blank 4, after hot forming and press quenching, to a temperature greater than a temperature of the uncontacted neighboring region 11 of the sheet-metal blank 4 but to no more than 900° C., for example to at most about 500° C. or to at most about 300° C.

Figure 3:
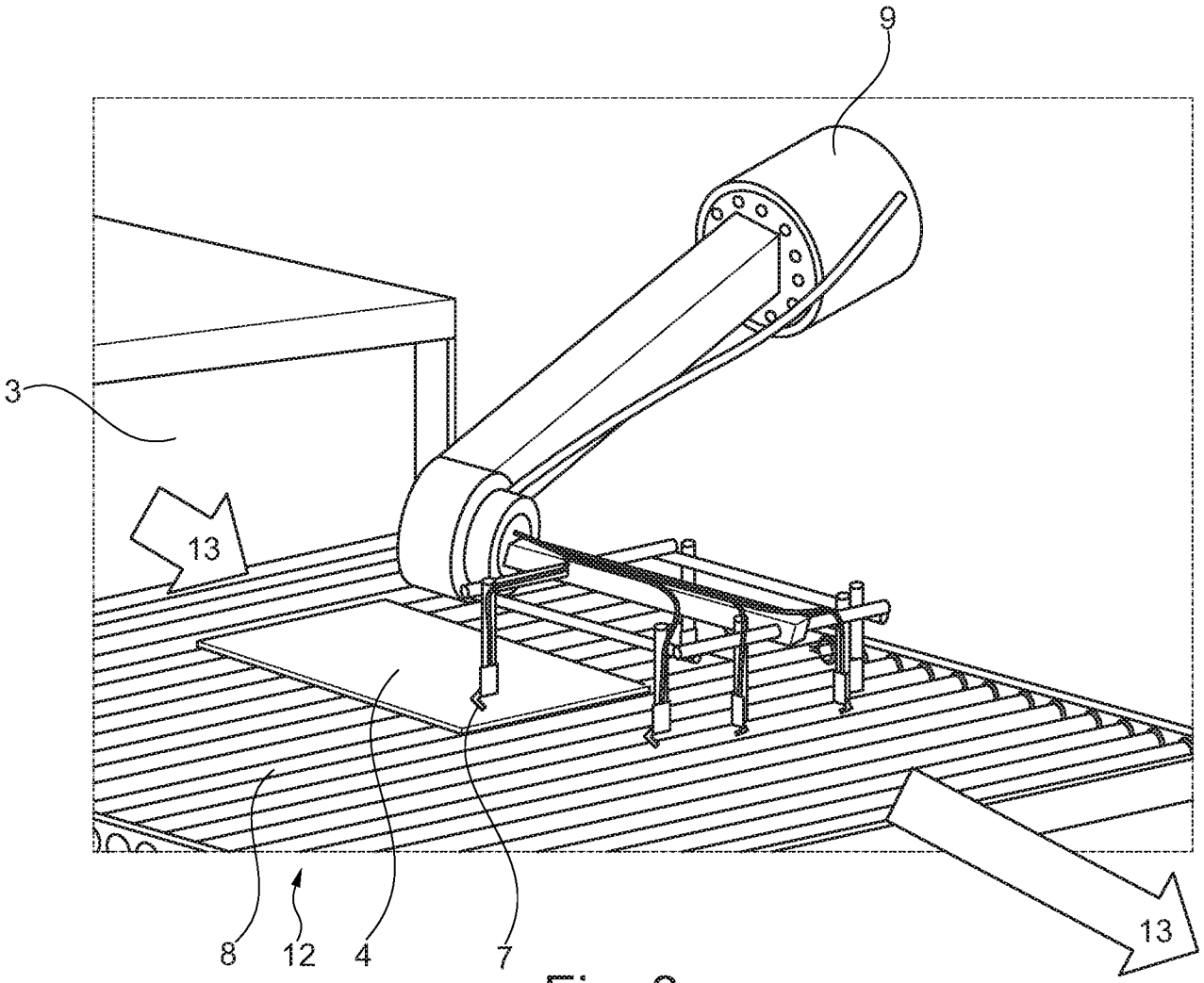
FIG. 3 shows a perspective view of a first transfer section of a sheet-metal blank to be hot formed and press quenched from the hot-forming line in FIG. 1.

FIG. 3 shows a perspective view of a first transfer section 12 of a sheet-metal blank 4 to be hot formed and press quenched from the hot-forming line 1 in FIG. 1. This first transfer section 12 represents the section of the hot-forming line 1 between the temperature control station 3 and the hot-forming and press-quenching tool 5, which is not illustrated in FIG. 3. A transfer direction 13 is illustrated by corresponding arrows.

Figure 4:
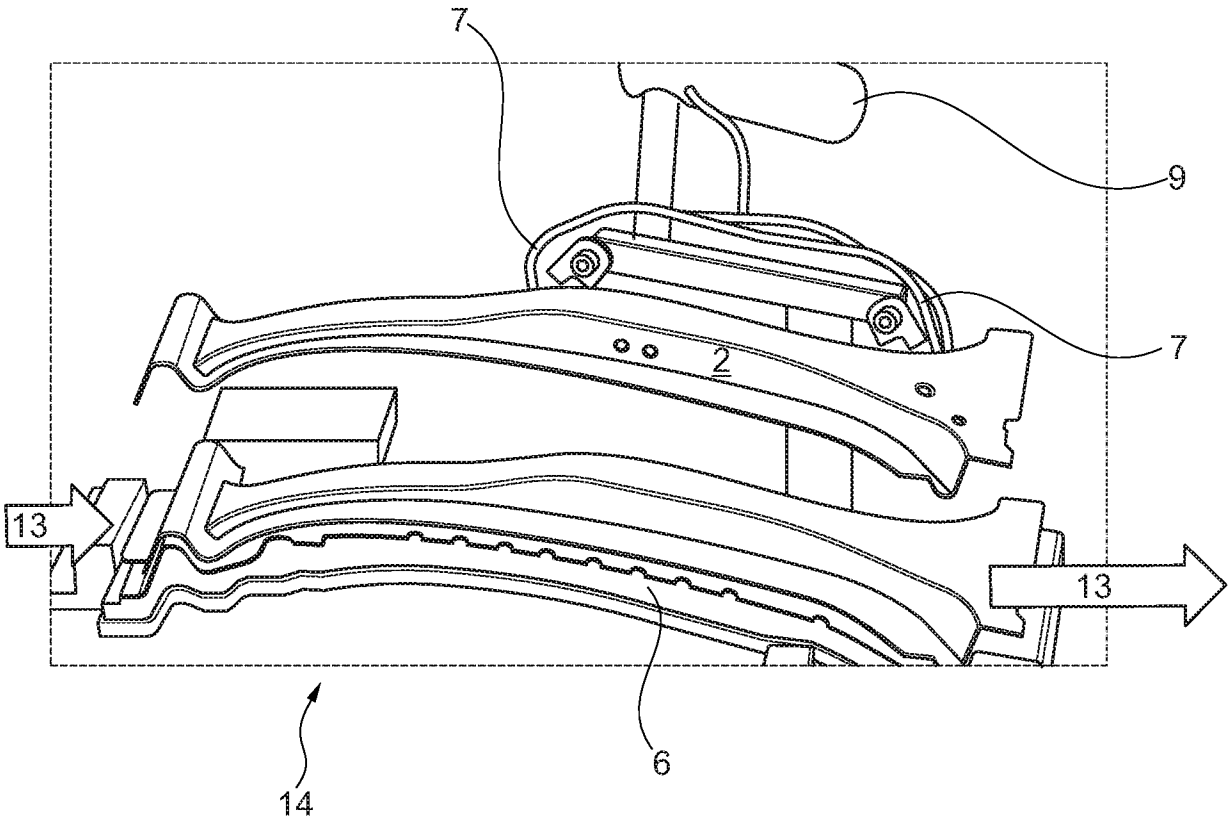
FIG. 4 shows a perspective view of a second transfer section of a hot-formed and press-quenched sheet-metal blank from the hot-forming line in FIG. 1.

FIG. 4 shows a perspective view of a second transfer section 14 of a hot-formed and press-quenched sheet-metal blank 4 or sheet-steel product 2 from the hot-forming line 1 in FIG. 1. This second transfer section 14 represents the section of the hot-forming line 1 which is situated downstream of the hot-forming and press-quenching tool 5, wherein only the lower forming tool 6 of the hot-forming and press-quenching tool 5 is visible.

Figure 5:
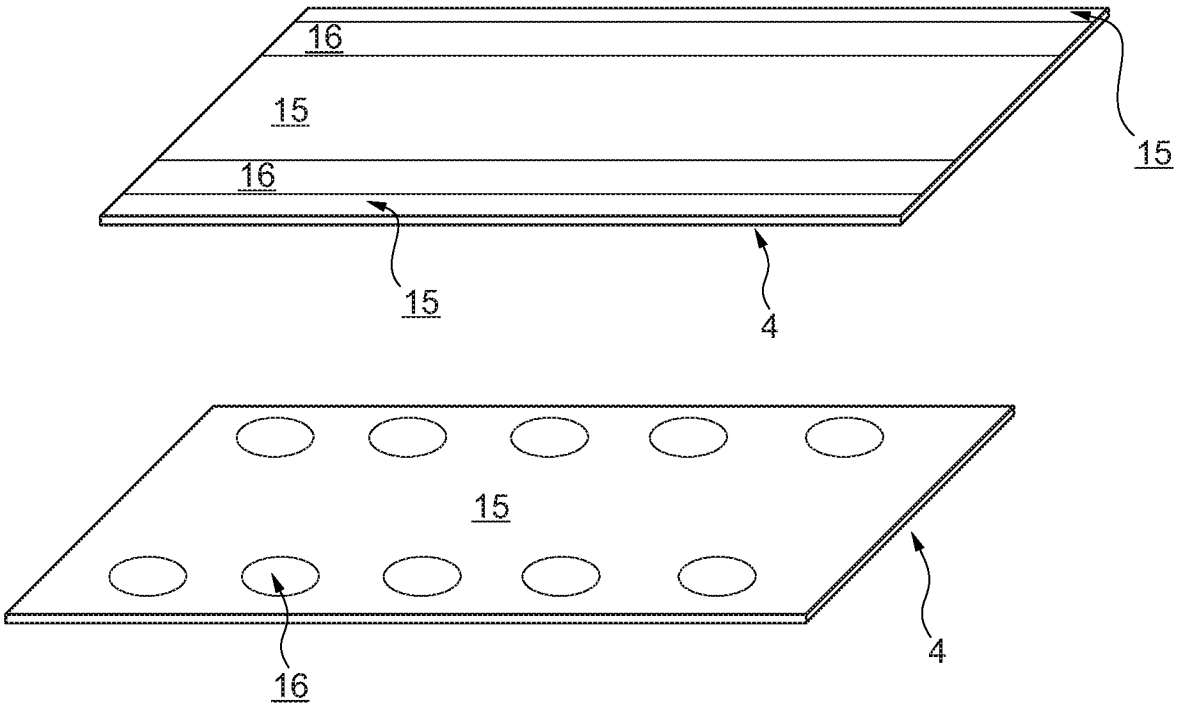
FIG. 5 shows a perspective view of a sheet-metal blank to be hot formed and press quenched with sheet regions at different temperatures brought about by the hot-forming line from FIG. 1.

FIG. 5 shows a perspective view of a sheet-metal blank 4 to be hot formed and press quenched with sheet regions 15 and 16 at different temperatures brought about by the hot-forming line 1 from FIG. 1. In particular, the temperature regions 15 represent regions of the sheet-metal blank 4 at a high temperature and the temperature regions 16 represent regions of the sheet-metal blank 4 at a low temperature. The respective temperature regions 15, 16 can be produced in the manner described herein by correspondingly configured blank grippers 7 of the kind described in relation to the hot-forming line 1 illustrated in FIG. 1.

The above-described hot-forming line according to the teachings of the present disclosure and the method according to the teachings of the present disclosure for producing hot-formed and press-quenched sheet-steel products are not restricted to the forms and aspects disclosed herein but also include further forms and aspects acting in the same way which emerge from technically worthwhile further combinations of the features described herein.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method for producing hot-formed and press-quenched sheet-steel products comprising:

heating at least one sheet-metal blank in a temperature control station;

hot forming and press quenching the heated sheet-metal blank in a hot-forming and press-quenching tool; and gripping and transferring the sheet-metal blank with at least one blank gripper, wherein the at least one blank gripper grips and transfers the sheet-metal blank before hot forming and press quenching, grips and transfers the sheet-metal blank after hot forming and press quenching, or grips and transfers the sheet-metal blank before and after hot forming and press quenching, and wherein the sheet-metal blank is at least one of:

cooled by the blank gripper, before hot forming and press quenching, in at least one contact region formed during gripping and transfer by the blank gripper, in relation to an uncontacted neighboring region of the sheet-metal blank adjoining the contact region, and heated by means of the blank gripper, after hot forming and press quenching, in the at least one contact region, in relation to the uncontacted neighboring region of the sheet-metal blank adjoining the contact region, wherein the sheet-metal blank in the at least one contact region is cooled by the blank gripper at a cooling rate of less than 27 K/s before hot forming and press quenching.

2. The method according to claim 1 further comprising heating the sheet-metal blank in the contact region by the at least one blank gripper after hot forming and press quenching to a temperature greater than a temperature of the uncontacted neighboring region of the sheet-metal blank adjoining the contact region and to no more than 900° C.

3. The method according to claim 1 further comprising placing the sheet-metal blank in the hot-forming and press-quenching tool by the at least one blank gripper before hot forming and press quenching.

4. The method according to claim 1 further comprising removing the sheet-metal blank from the hot-forming and press-quenching tool by the at least one blank gripper after hot forming and press quenching.

5. The method according to claim 1 further comprising placing the sheet-metal blank in the hot-forming and press-quenching tool by the at least one blank gripper before hot forming and press quenching, and removing the sheet-metal blank from the hot-forming and press-quenching tool by the at least one blank gripper after hot forming and press quenching.

6. The method according to claim 1, wherein the at least one blank gripper comprises:

a first blank gripper for gripping and transferring the sheet-metal blank before hot forming and press quenching, wherein the first blank gripper forms and cools the at least one contact region in relation to the uncontacted neighboring region adjoining the contact region during the gripping of the sheet-metal blank by the first blank gripper; and a second blank gripper for gripping and transferring the sheet-metal blank after hot forming and press quenching, wherein the second blank gripper heats the at least one contact region in relation to the uncontacted neighboring region adjoining the contact region during the gripping of the sheet-metal blank by the second blank gripper.

7. A hot-forming line for producing hot-formed and press-quenched sheet-steel products comprising:

a temperature control station for heating at least one sheet-metal blank;

a hot-forming and press-quenching tool for hot forming and press quenching the heated sheet-metal blank; and at least one blank gripper for gripping and transferring the sheet-metal blank before hot forming and press quenching, after hot forming and press quenching or before and after hot forming and press quenching, wherein:

the at least one blank gripper forms at least one contact region with the sheet-metal blank during the gripping of the sheet-metal blank and the at least one blank gripper is configured to at least one of:

cool the sheet-metal blank in the at least one contact region in relation to an uncontacted neighboring region adjoining the contact region during gripping and transferring before hot forming and press quenching, and heat the sheet-metal blank in the at least one contact region in relation to the uncontacted neighboring region adjoining the contact region during gripping and transferring after hot forming and press quenching, wherein the at least one blank gripper is configured to cool the at least one contact region at a cooling rate of less than 27 K/s before hot forming and press quenching of the sheet-metal blank.

8. The hot-forming line according to claim 7, wherein the at least one blank gripper is configured to heat the at least one contact region after hot forming and press quenching of the sheet-metal blank to a temperature greater than a temperature of the uncontacted neighboring region of the sheet-metal blank adjoining the contact region and to no more than 900° C.

9. The hot-forming line according to claim 7, wherein the at least one contact region is arranged in a joining section of the sheet-metal blank configured for joining the hot-formed and press-hardened sheet-steel product to another component.

10. The hot-forming line according to claim 9, wherein the joining section of the sheet-metal blank is a connecting flange.

11. The hot-forming line according to claim 7, wherein the at least one blank gripper is configured to place the sheet-metal blank in the hot-forming and press-quenching tool before hot forming and press quenching.

12. The hot-forming line according to claim 7, wherein the at least one blank gripper is configured to remove the sheet-metal blank from the hot-forming and press-quenching tool after hot forming and press quenching.

13. The hot-forming line according to claim 7, wherein the at least one blank gripper is configured to place the sheet-metal blank in the hot-forming and press-quenching tool before hot forming and press quenching, and to remove the sheet-metal blank from the hot-forming and press-quenching tool after hot forming and press quenching.

14. The hot-forming line according to claim 7, wherein the at least one blank gripper comprises:

a first blank gripper configured to cool the sheet-metal blank in the at least one contact region in relation to the uncontacted neighboring region during gripping and transferring by the first blank gripper before hot forming and press quenching; and a second blank gripper configured to heat the sheet-metal blank in the at least one contact region in relation to the uncontacted neighboring region during gripping and transferring by the second blank gripper after hot forming and press quenching.

15. The hot-forming line according to claim 14, wherein the second blank gripper is configured to heat the contact region after hot forming and press quenching of the sheet-metal blank to a temperature greater than a temperature of the uncontacted neighboring region of the sheet-metal blank adjoining the contact region and to no more than 900° C.

16. The hot-forming line according to claim 14, wherein the first blank gripper is configured to place the sheet-metal blank in the hot-forming and press-quenching tool before hot forming and press quenching, and the second blank gripper is configured to remove the sheet-metal blank from the hot-forming and press-quenching tool after hot forming and press quenching.

17. A hot-forming line for producing hot-formed and press-quenched sheet-steel products comprising:

a temperature control station for heating at least one sheet-metal blank;

a hot-forming and press-quenching tool for hot forming and press quenching the heated sheet-metal blank;

a first blank gripper for gripping and transferring the sheet-metal blank before hot forming and press quenching, wherein the first blank gripper is configured to form and cool at least one contact region with the sheet-metal blank in relation to an uncontacted neighboring region adjoining the contact region during the gripping of the sheet-metal blank by the first blank gripper; and a second blank gripper for gripping and transferring the sheet-metal blank after hot forming and press quenching, wherein the second blank gripper is configured to heat the at least one contact region in relation to the uncontacted neighboring region of the sheet-metal blank adjoining the contact region during the gripping of the sheet-metal blank by the second blank gripper.

18. The hot-forming line according to claim 17, wherein the first blank gripper is configured to place the sheet-metal blank in the hot-forming and press-quenching tool before hot forming and press quenching, and the second blank gripper is configured to remove the sheet-metal blank from the hot-forming and press-quenching tool after hot forming and press quenching.

* * * * *